US007984964B2

(12) United States Patent
Desire et al.

(10) Patent No.: US 7,984,964 B2
(45) Date of Patent: Jul. 26, 2011

(54) INK COLLECTION DEVICE FOR A SERVICING STATION

(75) Inventors: Régis Desire, Sceaux (FR); Le Gallo Stéphane, Savigny sur Orge (FR)

(73) Assignee: Neopost Technologies, Bagneux (FR)

( * ) Notice: Subject to any disclaimer, the term of this patent is extended or adjusted under 35 U.S.C. 154(b) by 259 days.

(21) Appl. No.: 12/268,731

(22) Filed: Nov. 11, 2008

(65) Prior Publication Data

US 2009/0128598 A1 May 21, 2009

(30) Foreign Application Priority Data

Nov. 13, 2007 (FR) ..... 07 58983

(51) Int. Cl.
*B41J 2/165* (2006.01)

(52) U.S. Cl. ..... 347/36
(58) Field of Classification Search ..... 347/36
See application file for complete search history.

(56) References Cited

U.S. PATENT DOCUMENTS

| | | | | |
|---|---|---|---|---|
| 5,563,639 | A * | 10/1996 | Cameron et al. | 347/34 |
| 6,357,853 | B1 * | 3/2002 | Askren et al. | 347/36 |
| 6,585,347 | B1 | 7/2003 | Johnson et al. | |
| 2003/0067505 | A1 | 4/2003 | Kumagai | |

FOREIGN PATENT DOCUMENTS

| | | | |
|---|---|---|---|
| EP | 0 705 699 | A1 | 4/1996 |
| EP | 1 403 056 | A1 | 3/2004 |

* cited by examiner

*Primary Examiner* — Jerry T Rahll
(74) *Attorney, Agent, or Firm* — Sughrue Mion, PLLC

(57) ABSTRACT

An ink collection device for a servicing station of a franking machine, said ink collection device comprising: an ink collection reservoir for receiving the ink ejected, during a servicing stage, by ink ejection nozzles of at least one print module; at least one drainage duct placed above the reservoir and opening out in register with said at least one print module while defining a gap between a top of the drainage duct and the print module; and, mounted across said at least one drainage duct and at a small predetermined distance from the top of the drainage duct, means for causing the fine ink droplets ejected by said ink ejection nozzles to coalesce to form a plurality of thicker ink drops, and for causing said ink drops to drip under gravity into said ink collection reservoir.

4 Claims, 2 Drawing Sheets

FIG.3
PRIOR ART
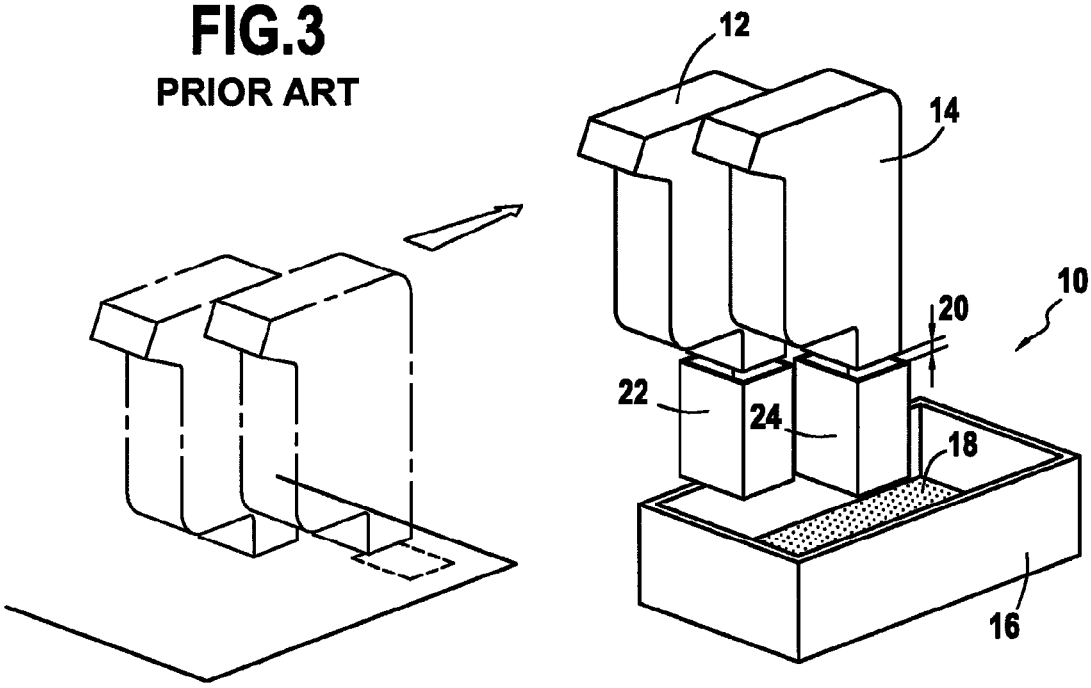
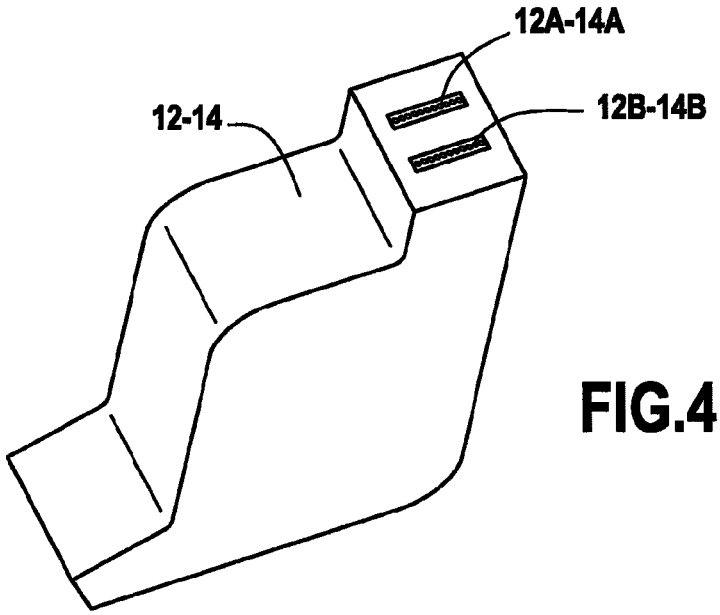
FIG.4

INK COLLECTION DEVICE FOR A SERVICING STATION

FIELD OF THE INVENTION

The present invention relates exclusively to the field of mail handling and it relates more particularly to an ink collection device in a postage meter or franking machine for franking mailpieces using inkjet printing technology.

PRIOR ART

It is well known that using an inkjet print head is affected by clogging-up of the ink ejection nozzles of the head.

Therefore, inkjet ejection nozzles need to be cleaned periodically and it is necessary to spit ink out during such cleaning so as not to leave dried ink in the nozzles. Since the lifespan of the print head of a franking machine can currently reach about 1.5 million cycles, such periodic spraying of ink represents a relatively large quantity of residual ink (typically, it is recommended to spit out 4000 droplets at each cleaning cycle). In current machines, that quantity is accumulated on a plane sponge disposed in a reservoir or "spittoon" mounted at the servicing station for servicing the print head.

Unfortunately, such a solution, as illustrated, for example, by Patent Application US2003/0142150 is not without drawbacks. Firstly, due to the large volume of ink spat out in a limited time during the cleaning cycle, the sponge must be a relatively long way away from the ink ejection nozzles, and this gives rise to ink-droplet aerosol phenomena that then soil the servicing station and more generally the structure of the franking machine as a whole, in particular the various cells for detecting presence of mailpieces. In addition, such aerosol phenomena are worsened by the flow of air generated by the fan when the temperature of the motor in the machine rises or by the movement of the mailpieces after a cleaning cycle.

OBJECT AND DEFINITION OF THE INVENTION

The present invention proposes to mitigate those drawbacks with an ink collection device for a servicing station of a franking machine, said ink collection device comprising:

- an ink collection reservoir for receiving the ink ejected, during a servicing stage, by ink ejection nozzles of at least one print module; and
- at least one drainage duct placed above the reservoir and opening out in register with said at least one print module while defining a gap between a top of said drainage duct and said print module;
- wherein said ink collection device further comprises at least one smooth pin mounted across said at least one drainage duct, being placed at a determined distance from said ink ejection nozzles and aligned on said nozzles, said pin having a diameter that is adapted to the diameter of said ink ejection nozzles and to said determined distance, so as to cause the fine ink droplets ejected by said ink ejection nozzles to coalesce to form a plurality of thicker ink drops, and so as to cause said ink drops to drip under gravity into said ink collection reservoir.

Thus, the fine ink droplets ejected by the nozzles are collected, and run off as thick drops before the aerosol phenomena occur as in the prior art. Ink sprays are avoided and there is no longer any soiling of the servicing station or of the franking machine, and in particular of the electronic circuits thereof and of the casing thereof.

Preferably, said determined distance between said ink ejection nozzles and said smooth pin lies in the range 3 millimeters (mm) to 5 mm, and the diameter of said smooth pin lies in the range 1 mm to 2 mm.

When said print module has two parallel rows of ink ejection nozzles, said drainage duct has two parallel pins that are united to form a hairpin-shape pin with two parallel open branches, the curved junction portion between the two branches of said hairpin-shape pin being held securely in said drainage duct by a fastener stud.

The present invention also provides a franking machine servicing station including the above-mentioned ink collection reservoir.

BRIEF DESCRIPTION OF THE DRAWINGS

The characteristics and advantages of the present invention appear more clearly from the following description given by way of non-limiting indication and with reference to the accompanying drawings, in which:

FIG. 3 is a perspective view of a prior art ink collection device; and

FIG. 4 is a view from below of a standard print module having two rows of ink ejection nozzles, which module is implemented both in the prior art ink collection device and in the ink collection device of the invention.

DETAILED DESCRIPTION OF A PREFERRED EMBODIMENT

Figure 1A:
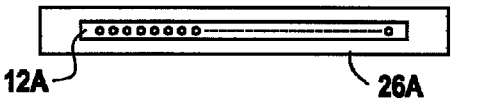
FIG. 1A shows a detail of FIG. 1.
Figure 2:
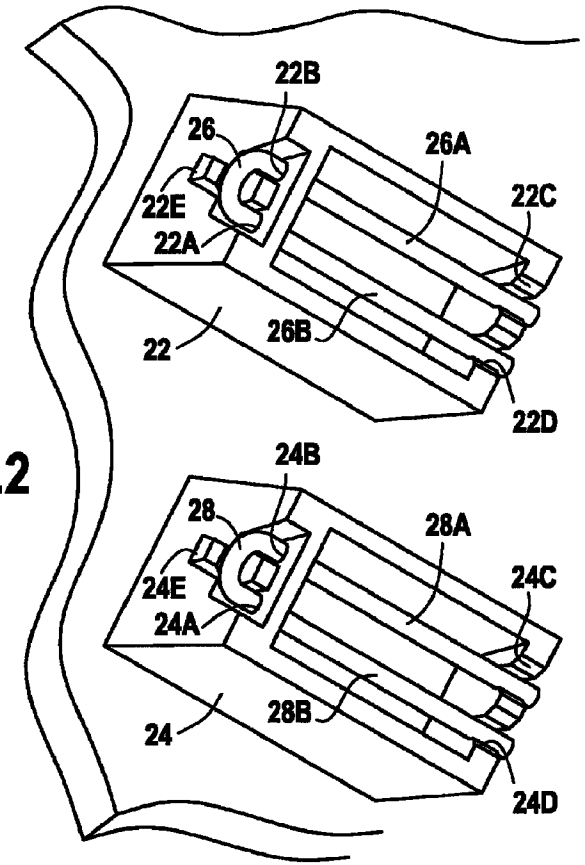
FIG. 2 is a perspective view showing the drainage ducts of the device of FIG. 1.

FIG. 3 is a fragmentary diagrammatic view of a prior art ink collection device implemented in a servicing station of a franking machine including two inkjet modules 12, 14 mounted side-by-side and offset in two mutually perpendicular directions. As is known, when the print modules are in the servicing position (i.e. set back from the operating position, shown in dashed lines, in the path along which the mailpieces are conveyed), an ink collection reservoir 16 equipped with its absorbent foam or sponge 18 is disposed under said two inkjet print modules. As shown in FIG. 4, each print module has two parallel rows of ink ejection nozzles 12A, 12B; 14A, 14B, each row typically comprising 250 nozzles. In order to avoid it having to be changed too frequently, the reservoir presents a volume that is relatively large, and it must therefore be placed some distance away from the ink ejection nozzles. Two drainage ducts 22, 24 are thus provided between the reservoir and the two print modules, which ducts are placed above the reservoir and are in the form of wells of substantially rectangular shape, each duct being disposed vertically in register with a respective one of the two modules and draining the ink from the ejection nozzles towards the sponge of the reservoir. The ejection nozzles are separated from the tops of said ducts merely by respective gaps 20 of in the range 1 mm to 2 mm that suffice to enable the print modules to move. Naturally, the ducts are of cross-section that is dimensioned to surround as closely as possible the two rows of nozzles with which each print module is provided.

During the periodic cleaning of the print modules, the ejection nozzles of those modules spit ink out and thus spray ink through the drainage ducts to the reservoir that faces them. Ink is also spat out when the machine is switched on, and after it has been put on standby for a prolonged period of time.

However, although such spraying is, in theory, directed due to the action of the drainage ducts, it is impossible to avoid aerosol phenomena that take advantage of the gap 20 and quickly lead to the servicing station and the various elements of the surrounding franking machine being soiled. In practice, with one cleaning cycle every 300 printing operations, the inventors have observed that it takes only 30,000 print operations for the servicing station to be totally soiled.

Figure 1:
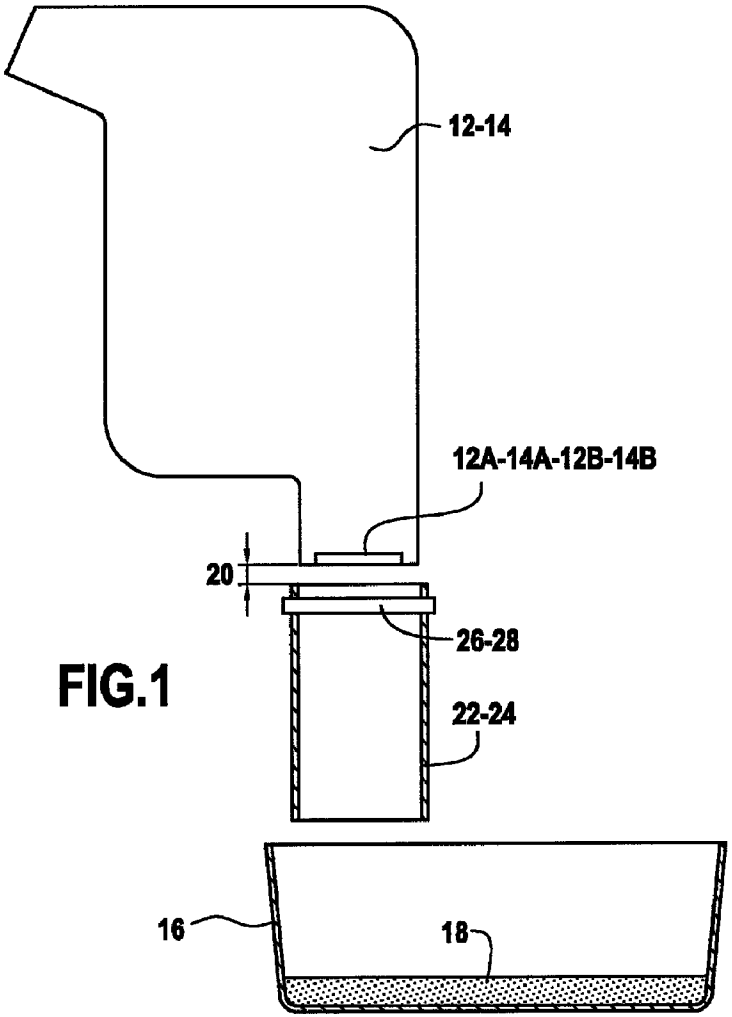
FIG. 1 is a diagrammatic view showing the improved ink collection device of the invention.

That is why, in accordance to the invention, and as shown in FIGS. 1 and 1A, provision is made to place a smooth pin 26, 28 at a small predetermined distance, typically no more than 5 mm, from each row of ink injection nozzles, which pin is aligned along the row and placed across each well that is placed above the ink collection reservoir 16 and that opens out into said reservoir. For this purpose, each well is provided with openings 22A, 22B, 22C, 22D; 24A, 24B, 24C, 24D in two opposite faces. When each print module has two parallel rows, as shown, the two pins can be united in the manner of a hairpin-shape pin having two open branches 26*a*, 26B; 28A, 28B. Said hairpin-shape pin is held securely at the curved junction portion between its two branches by a fastener stud 22E, 24E extending from the outside face of each duct. The small gap existing between the ejection nozzles and the pins makes it possible to collect the ink before aerosol phenomena occur as in the prior art. Once they have been ejected, the fine ink droplets flatten out on the pins, and coalesce to from thicker ink drops that run off around the pins and ultimately drip under gravity directly into the reservoir, or trickle down along their respective ducts. The entirely smooth surface of the pin allows the ink to run off quickly and prevents droplets from piling up on top of the pin, and its small diameter does not give rise to any delay in the formation of the ink drops.

More particularly, the diameter of the pin is adapted to the diameter of the nozzles and to the distance between the nozzles and the pin. If the diameter of the pin is too small or if the pin is too far away from the nozzles, the dispersion of the droplets is not braked. If said diameter is too large, the formation of droplets is disrupted and, when the print module has two rows of nozzles, a bridge of ink forms between the two pins that are placed below respective ones of the two rows and that are then too close together.

In practice, for nozzle diameters of 0.04 mm and a pitch of 4.11 mm from row to row, each of which has a length of 12.66 mm, the inventors have obtained excellent results with a pin having a diameter of 1.5 mm and placed at a distance of 3.8 mm from the nozzles. For a distance between the nozzles and the pin lying in the range 3 mm to 5 mm and a nozzle diameter lying in the range 0.02 mm to 0.05 mm, a pin diameter lying in the range 1 mm to 2 mm is entirely satisfactory.

Thus, with the invention, by collecting ink drops as close as possible to the ejection nozzles, soiling of the servicing station and thus of the franking machine is delayed considerably, given that tests performed by the inventors show that even after 1.5 million print cycles, no significant soiling is observed, including on the casing of the franking machine.

What is claimed is:

1. An ink collection device for a servicing station of a franking machine, said ink collection device comprising:

an ink collection reservoir for receiving the ink ejected, during a servicing stage, by ink ejection nozzles of at least one print module; and at least one drainage duct placed above the reservoir and opening out in register with said at least one print module while defining a gap between a top of said drainage duct and said print module;

wherein said ink collection device further comprises at least one smooth pin mounted across said at least one drainage duct, being placed at a determined distance from said ink ejection nozzles and aligned on said nozzles, said pin having a diameter that is adapted to the diameter of said ink ejection nozzles and to said determined distance, so as to cause the fine ink droplets ejected by said ink ejection nozzles to coalesce to form a plurality of thicker ink drops, and so as to cause said ink drops to drip under gravity into said ink collection reservoir.

2. An ink collection device according to claim 1, wherein said determined distance between said ink ejection nozzles and said smooth pin lies in the range 3 mm to 5 mm, and the diameter of said smooth pin lies in the range 1 mm to 2 mm.

3. An ink collection device according to claim 1, wherein, when said print module has two parallel rows of ink ejection nozzles, said drainage duct has two parallel pins that are united to form a hairpin-shape pin with two parallel open branches, the curved junction portion between the two branches of said hairpin-shape pin being held securely in said drainage duct by a fastener stud.

4. A franking machine servicing station including an ink collection device according to claim 1.

* * * * *